US008353731B1

(12) United States Patent
Huang et al.

(10) Patent No.: US 8,353,731 B1
(45) Date of Patent: Jan. 15, 2013

(54) PLUG CONNECTOR

(75) Inventors: Guang-Li Huang, New Taipei (TW); Li-Jun Xu, New Taipei (TW); Ming-Han Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/281,449

(22) Filed: Oct. 26, 2011

(51) Int. Cl.
*H01R 13/502* (2006.01)

(52) U.S. Cl. ..... 439/701

(58) Field of Classification Search ..... 439/701, 439/707, 712, 724, 660, 905, 599, 634, 686, 439/695, 607.01, 607.45, 607.5
See application file for complete search history.

(56) References Cited

U.S. PATENT DOCUMENTS 6,007,385 A * 12/1999 Wu ..... 439/607.45
6,955,568 B1 * 10/2005 Wu ..... 439/660
7,465,194 B1 * 12/2008 Ho et al. ..... 439/607.01
7,686,628 B2 * 3/2010 Lino et al. ..... 439/108
7,758,374 B2 * 7/2010 Yu et al. ..... 439/493
7,824,234 B2 * 11/2010 Kamata et al. ..... 439/752
8,052,431 B1 * 11/2011 He et al. ..... 439/78
8,070,525 B2 * 12/2011 Hou et al. ..... 439/660
8,197,281 B2 * 6/2012 Yang ..... 439/499
2005/0245132 A1 * 11/2005 Huang et al. ..... 439/607
2011/0195609 A1 * 8/2011 Su et al. ..... 439/660

* cited by examiner

*Primary Examiner* — Alexander Gilman
(74) *Attorney, Agent, or Firm* — Lin & Associates IP, Inc.

(57) ABSTRACT

A plug connector includes an insulating housing, a plurality of first terminals which are adapted to connect with a mating receptacle connector and include a first ground terminal, a first power terminal for connecting with an external power supply and at least two first signal terminals, a plurality of second terminals which include second power terminals adapted to transmit different voltage values, second ground terminals and a backup terminal, and a support body mounted to a rear side of the insulating housing. The first and second terminals are inserted forward in the insulating housing and each has a soldering arm penetrating rearward through the support body to be exposed outside and supported by the support body. A shielding shell encloses the insulating housing and the support body with the first and second terminals.

8 Claims, 3 Drawing Sheets

PLUG CONNECTOR

BACKGROUND OF THE INVENTION

1. Field of the Invention

The present invention relates to a plug connector, and more particularly to a multi-function plug connector.

2. The Related Art

Generally, an electronic product realizes data transmission often by virtue of an electrical connector. The rapid developments of the electronic products call for more stringent requirements to the electrical connectors. At present, a conventional plug connector includes an insulating housing, a plurality of electrical terminals disposed in the insulating housing, and a shielding shell enclosing the insulating housing with the electrical terminals. The electrical terminals include two signal terminals, one power terminal and one ground terminal. However, the plug connector with the four electrical terminals has a rather simple function and a poor expansibility. As a result, it is often hard to adapt to the rapid developments of the electronic products.

SUMMARY OF THE INVENTION

An object of the present invention is to provide a plug connector including an insulating housing of a substantial U-shape seen from a lateral view. The insulating housing has a base portion and a pair of tongue boards extending forward from a top and a bottom of a front side of the base portion. The tongue boards have two face-to-face inside faces thereof opened with a plurality of terminal fillisters of which each extends along a front-to-rear direction to further penetrate through the base portion. A plurality of first terminals is adapted to electrically connect with a mating receptacle connector and includes a first ground terminal, a first power terminal for connecting with an external power supply, and at least two first signal terminals. The first terminals are inserted forward in the corresponding terminal fillisters of the insulating housing and each has a first soldering arm projected behind the insulating housing. A plurality of second terminals includes second power terminals adapted to transmit different voltage values, second ground terminals and a backup terminal. The second terminals are inserted forward in the corresponding terminal fillisters of the insulating housing and each has a second soldering arm projected behind the insulating housing. A support body is mounted to a rear side of the insulating housing, and has a lid portion and a support portion protruded rearward from a substantial middle of a rear side of the lid portion. The support body defines a plurality of terminal passages each penetrating through the lid portion and the support portion. The first and second soldering arms of the first and second terminals pass through the terminal passages to be exposed outside and supported by the support portion. A shielding shell encloses the insulating housing and the support body with the first and second terminals.

As described above, the plug connector of the present invention utilizes the second terminals to strengthen and supply performances of the first terminals so as to realize a good expansibility thereof and achieve a multi-function connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
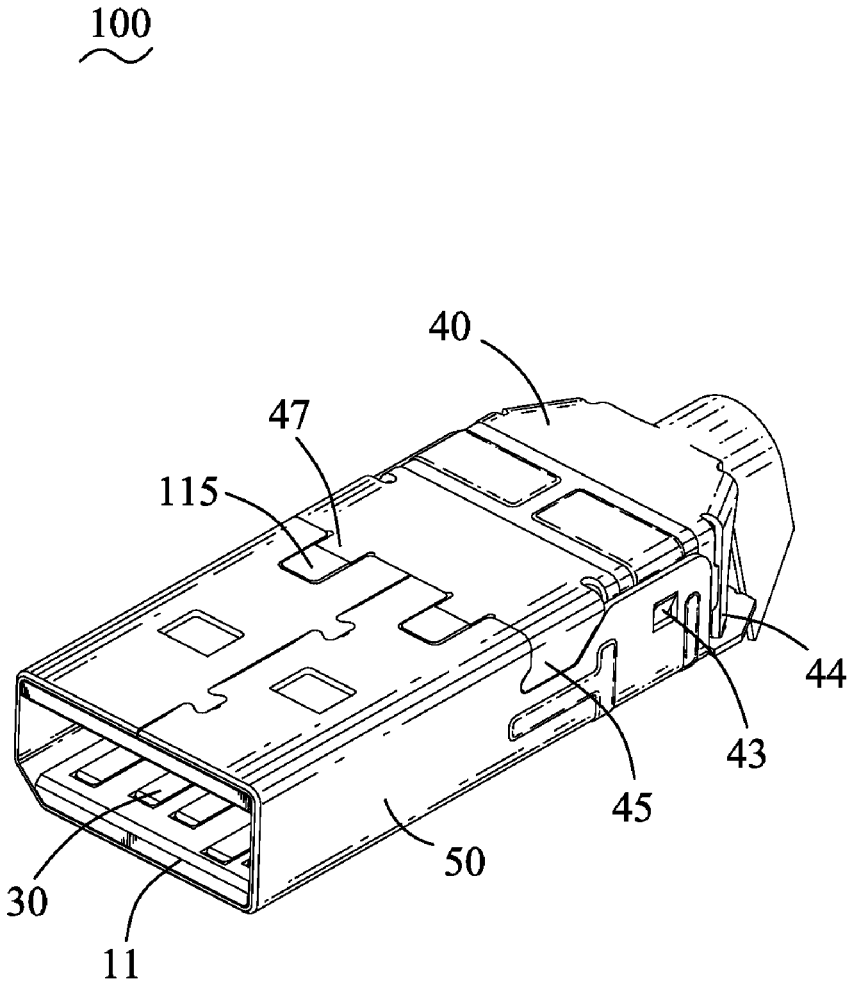
FIG. 1 is an assembled perspective view of a plug connector in accordance with an embodiment of the present invention.
Figure 2:
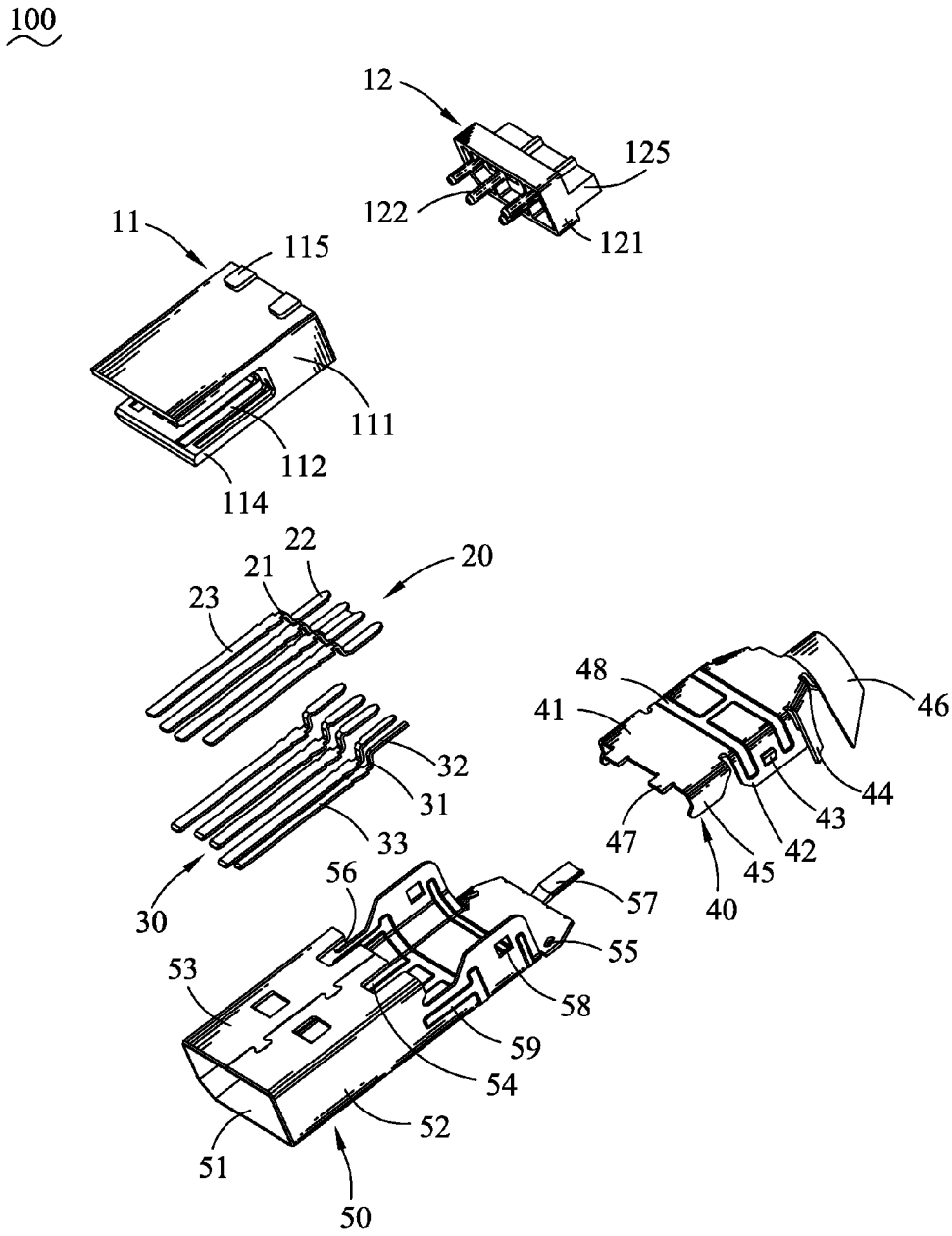
FIG. 2 is an exploded perspective view of the plug connector of FIG. 1.

Referring to FIG. 1 and FIG. 2, a plug connector 100 in accordance with an embodiment of the present invention includes an insulating housing 11, a support body 12, a plurality of first terminals 20 and second terminals 30, and a shielding shell.

Figure 3:
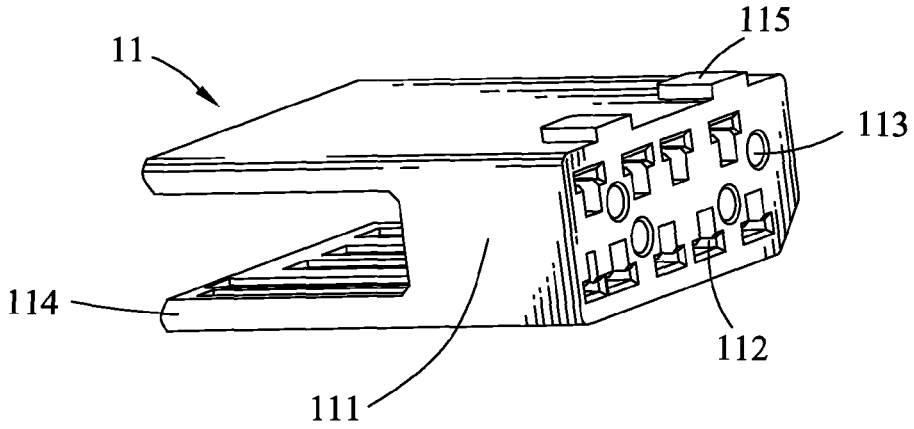
FIG. 3 is a perspective view of an insulating housing of the plug connector of FIG. 2.
Figure 4:
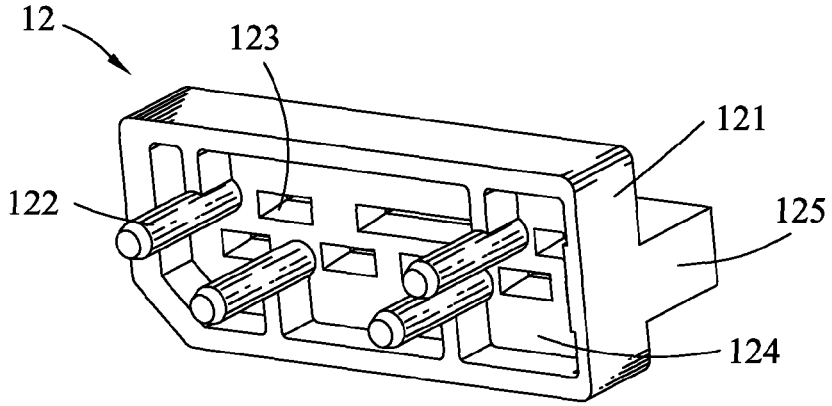
FIG. 4 is a perspective view of a support body of the plug connector of FIG. 2.

Referring to FIG. 2, FIG. 3 and FIG. 4, the insulating housing 11 shows a substantial U-shape seen from a lateral view, and has a rectangular base portion 111 and a pair of tongue boards 114 extending forward from a top and a bottom of a front side of the base portion 111. The tongue boards 114 have two face-to-face inside faces thereof opened with a plurality of terminal fillisters 112 respectively of which each extends along a front-to-rear direction to further penetrate through the base portion 111. A rear side of the base portion 111 defines a plurality of fastening holes 113 each concaved forward. A top side of the base portion 111 protrudes upward to form two locking blocks 115 apart arranged along a rear edge thereof. The support body 12 has a lid portion 121 with a front side thereof matched with the rear side of the base portion 111 and concaved rearward to form a receiving cavity 124, and a support portion 125 protruded rearward from a middle of a rear side of the lid portion 121 and parallel with the tongue boards 114. A rear side of the receiving cavity 124 defines a plurality of terminal passages 123 each penetrating rearward through the lid portion 121 and the support portion 125. The rear side of the receiving cavity 124 further protrudes forward to form a plurality of fastening pillars 122.

Referring to FIG. 2 again, each of the first terminals 20 has a first connecting arm 21, a first soldering arm 22 and a first contact arm 23 which extend from two distal ends of the first connecting arm 21 towards two opposite directions substantially perpendicular to the first connecting arm 21. Each of the second terminals 30 has a second connecting arm 31, a second soldering arm 32 and a second contact arm 33 which extend from two distal ends of the second connecting arm 31 towards two opposite directions substantially perpendicular to the second connecting arm 31. In this embodiment, there are four said first terminals 20 of which one is acted as first ground terminal, another one is acted as first power terminal for connecting with an external power supply, and remained two are acted as first signal terminals, and there are five said second terminals 30 which include two second power terminals, two second ground terminals and one backup terminal, wherein the first terminals 20 are used to electrically connect with a mating receptacle connector (not shown) to realize general input/output functions, and the two second power terminals are adapted to transmit different voltage values.

With reference to FIG. 2 again, the shielding shell includes a first shell 40 and a second shell 50 engaged with each other to enclose the insulating housing 11 and the support body 12 together. The first shell 40 has a base plate 41, two side plates 42 extending downward from substantial middles of two side edges of the base plate 41, a pair of locking plates 45 bent downward from fronts of the two side edges of the base plate 41 with a bottom of a front edge being further protruded forward, two restraining slices 44 extending downward from rears of the two side edges of the base plate 41, and an arc-shaped upper coiling portion 46 extending rearward from a middle of a rear edge of the base plate 41 with two ends being bent downward. A substantial middle of the base plate 41 is punched downward to form a first strengthening rib 48 further spread to the side plates 42 for avoiding the first shell 40 deforming. A front edge of the base plate 41 protrudes forward to form two positioning slices 47 spaced from each other. Each of the side plates 42 has a portion punched outward to form a buckling block 43.

The second shell 50 has a substantially rectangular base board 51, two side boards 52 extending upward from two opposite side edges of the base board 51 and apart from a rear edge of the base board 51, a pair of top boards 53 face-to-face extending from fronts of top edges of the side boards 52 to be connected with each other, and a lower coiling portion 57 extending rearward from a middle of the rear edge of the base board 51. A rear edge of each top board 53 is concaved forward to form a positioning slot 54. A portion of the top edge of each side board 52 adjacent to the top board 53 is concaved downward and then forward to form a locking gap 56. A buckling hole 58 is opened in a rear end of each side board 52. The base board 51 has a substantial middle thereof punched upward to form a second strengthening rib 59 further spread to the side boards 52 for avoiding the second shell 50 deforming, and has two opposite sides of a rear end thereof opened with a pair of fixing holes 55.

Referring to FIGS. 1-4, in assembly, the first contact arms 23 of the first terminals 20 and the second contact arms 33 of the second terminals 30 are inserted forward into the terminal fillisters 112 of the insulating housing 11 respectively, with the first soldering arms 22 and the second soldering arms 32 stretching behind the base portion 111. The support body 12 is mounted to the rear side of the base portion 111 by means of the fastening pillars 122 being inserted in the respective fastening holes 113, with the first soldering arms 22 and the second soldering arms 32 penetrating through the terminals passages 123 to be exposed outside and supported by the support portion 125 for the convenience of the soldering process thereof. The second shell 50 is put rearward around the insulating housing 11 until the locking blocks 115 are inserted into the corresponding positioning slots 54 and abut against front edges of the corresponding positioning slots 54. Then, the first shell 40 is covered onto the support body 12 and matched with the second shell 50 to together enclose the insulating housing 11 and the support body 12 therein. The first shell 40 and the second shell 50 are secured together by virtue of the locking plates 45 being locked in the locking gaps 56, the buckling blocks 43 being buckled in the buckling holes 58, and distal ends of the restraining slices 44 being inserted in the fixing holes 55. The positioning slices 47 of the first shell 40 are positioned in the corresponding positioning slots 54 of the second shell 50 to block the locking blocks 115 in the respective positioning slots 54 so as to secure the shielding shell and the insulating housing 11 together. The upper coiling portion 46 and the lower coiling portion 57 are cooperated with each other to form a coiling portion for receiving cables (not shown) soldered with the first and second soldering arms 22, 32.

As described above, the plug connector 100 of the present invention utilizes the second terminals 30 to strengthen and supply performances of the first terminals 20 so as to realize a good expansibility thereof and achieve a multi-function connector.

What is claimed is:

1. A plug connector, comprising:

an insulating housing of a substantial U-shape seen from a lateral view, the insulating housing having a base portion and a pair of tongue boards extending forward from a top and a bottom of a front side of the base portion, the tongue boards having two face-to-face inside faces thereof opened with a plurality of terminal fillisters of which each extends along a front-to-rear direction to further penetrate through the base portion;

a plurality of first terminals adapted to electrically connect with a mating receptacle connector and including a first ground terminal, a first power terminal for connecting with an external power supply, and at least two first signal terminals, the first terminals being inserted forward in the corresponding terminal fillisters of the insulating housing and each having a first soldering arm projected behind the insulating housing;

a plurality of second terminals including second power terminals adapted to transmit different voltage values, second ground terminals and a backup terminal, the second terminals being inserted forward in the corresponding terminal fillisters of the insulating housing and each having a second soldering arm projected behind the insulating housing;

a support body mounted to a rear side of the insulating housing, the support body having a lid portion and a support portion protruded rearward from a substantial middle of a rear side of the lid portion, the support body defining a plurality of terminal passages each penetrating through the lid portion and the support portion, the first and second soldering arms of the first and second terminals passing through the terminal passages to be exposed outside and supported by the support portion; and a shielding shell enclosing the insulating housing and the support body with the first and second terminals.

2. The plug connector as claimed in claim 1, wherein a rear side of the base portion defines a plurality of fastening holes, a front side of the lid portion protrudes forward to form a plurality of fastening pillars inserted in the fastening holes of the base portion to secure the support body and the insulating housing together.

3. The plug connector as claimed in claim 1, wherein a top side of the base portion protrudes upward to form two locking blocks apart arranged along a transverse direction thereof, the shielding shell includes a first shell and a second shell engaged with each other, the first shell has a base plate covered on the support body, a front edge of the base plate protrudes forward to form two positioning slices spaced from each other, the second shell has a base board, two side boards extending upward from two opposite side edges of the base board and a pair of top boards face-to-face extending from fronts of top edges of the side boards to be connected with each other, the second shell is put around the insulating housing with rears of the base board and the side boards cooperating with the first shell to enclose the support body, a rear edge of each top board is concaved forward to form a positioning slot, the positioning slices are positioned in the corresponding positioning slots to restrain the locking blocks in the respective positioning slots so as to secure the shielding shell and the insulating housing together.

4. The plug connector as claimed in claim 3, wherein substantial middles of two side edges of the base plate of the first shell extend downward to form two side plates of which each has a portion punched outward to form a buckling block, a buckling hole is opened in a rear end of each side board of the second shell to buckle the buckling block of the first shell therein.

5. The plug connector as claimed in claim 3, wherein fronts of two side edges of the base plate of the first shell are bent downward to form a pair of locking plates each having a bottom of a front edge thereof further protruded forward, a portion of the top edge of each side board of the second shell adjacent to the top board is concaved downward and then forward to form a locking gap for fastening the locking plate of the first shell therein.

6. The plug connector as claimed in claim 3, wherein rears of two side edges of the base plate of the first shell extend downward to form two restraining slices, the base board of the second shell has two opposite sides of a rear end thereof opened with a pair of fixing holes, bottom ends of the restraining slices are respectively inserted in the fixing holes.

7. The plug connector as claimed in claim 3, wherein an arc-shaped upper coiling portion extends rearward from a middle of a rear edge of the base plate of the first shell with two ends being bent downward, a middle of a rear edge of the base board of the second shell extends rearward to form a lower coiling portion cooperating with the upper coiling portion to form a coiling portion.

8. The plug connector as claimed in claim 3, wherein a substantial middle of the base plate of the first shell is punched downward to form a first strengthening rib, the base board of the second shell has a substantial middle thereof punched upward to form a second strengthening rib further spread to the side boards.

* * * * *